US007007336B2

(12) United States Patent
Roney et al.

(10) Patent No.: US 7,007,336 B2
(45) **Date of Patent: *Mar. 7, 2006**

(54) AGITATOR CONSTRUCTION

(75) Inventors: Jeffrey T. Roney, Stanford, KY (US); Eric E. Muhlenkamp, Danville, KY (US)

(73) Assignee: Panasonic Corporation of North America, Secaucus, NJ (US)

( * ) Notice: Subject to any disclaimer, the term of this patent is extended or adjusted under 35 U.S.C. 154(b) by 9 days.

This patent is subject to a terminal disclaimer.

(21) Appl. No.: 10/715,036

(22) Filed: Nov. 17, 2003

(65) Prior Publication Data

US 2004/0148723 A1 Aug. 5, 2004

Related U.S. Application Data

(63) Continuation of application No. 10/433,851, filed as application No. PCT/US02/11291 on Apr. 10, 2002.

(60) Provisional application No. 60/282,865, filed on Apr. 10, 2001.

(51) Int. Cl.
*A47L 9/04* (2006.01)

(52) U.S. Cl. ..... 15/179; 15/141.2; 15/383; 15/389; 492/47

(58) Field of Classification Search ..... 15/179, 15/141.2, 182, 383, 389–392; 492/47
See application file for complete search history.

(56) References Cited

U.S. PATENT DOCUMENTS 1,364,554 A * 1/1921 Howard ..... 15/383
1,422,100 A * 7/1922 Hoff ..... 15/188
1,449,003 A * 3/1923 Howard ..... 15/375
1,495,182 A * 5/1924 Howard ..... 15/182
1,611,684 A * 12/1926 Serva ..... 15/388
1,957,506 A * 5/1934 Smellie ..... 15/366
2,037,648 A * 4/1936 Bergstrom ..... 15/179
2,372,404 A * 3/1945 Taylor ..... 15/179
2,395,430 A 2/1946 Sloan
2,459,007 A 1/1949 Taylor
3,022,533 A * 2/1962 Hebenstreit ..... 15/354
3,564,637 A 2/1971 Gollish
3,737,937 A 6/1973 Nordeen
4,173,807 A * 11/1979 Maier ..... 15/179
4,372,004 A 2/1983 Vermillion
4,446,595 A * 5/1984 Nakada et al. ..... 15/385
4,648,150 A 3/1987 Morishita et al.
4,977,640 A 12/1990 Hirano et al.
5,003,663 A * 4/1991 Sunagawa et al. ..... 15/366
5,115,538 A 5/1992 Cochran et al.
5,165,140 A 11/1992 Ide
5,249,328 A 10/1993 Shin
5,272,785 A 12/1993 Stegens
5,435,038 A 7/1995 Sauers
5,452,490 A 9/1995 Brundula et al.
6,085,383 A 7/2000 Wulff et al.

FOREIGN PATENT DOCUMENTS

JP 11-206629 * 8/1999

* cited by examiner

*Primary Examiner*—Mark Spisich
(74) *Attorney, Agent, or Firm*—King & Schickli, PLLC

(57) ABSTRACT

An agitator includes a high strength, continuous metal axle, a pulley held on one end of the metal axle and a sleeve of lightweight plastic material received over the axle. The agitator is manufactured by molding a pulley body onto an underlying metal support or D-nut, fitting an axle into the pulley, molding a sleeve around the axle and securing a cleaning structure on the sleeve.

12 Claims, 3 Drawing Sheets

AGITATOR CONSTRUCTION

This application is a continuation of U.S. patent application Ser. No. 10/433,851 filed on Jun. 5, 2003 which is a U.S. National Stage Application of International Patent Application Serial No. PCT/US02/11291 filed on Apr. 10, 2002 which claims the benefit of U.S. Provisional Patent Application Ser. No. 60/282,865 filed Apr. 10, 2001.

TECHNICAL FIELD

This invention relates to vacuum cleaners, extractors and the like and, more particularly, to an agitator for use in such cleaning equipment.

BACKGROUND OF THE INVENTION

Upright vacuum cleaners, extractors and canister vacuum cleaners with power nozzles incorporating rotary agitators are presently manufactured and marketed by a number of different companies. The agitators carry cleaning structures such as rubber wipers, beater bars, brushes and tufted bristles to brush or beat dirt and debris from an underlying surface such as a carpet being cleaned.

The rotary agitators are rotated quickly at speeds up to 2,500–6,500 rpm and through engagement with the underlying carpet, are subjected to significant sheer forces. As such, the agitators must have relatively high inherent strength to withstand operation over an extended service life.

The present invention relates to a relatively low profile agitator constructed to have the necessary strength to reliably and dependably function over a long service life. Such a low profile agitator may, advantageously, be incorporated into a low profile nozzle assembly of an upright vacuum cleaner, power head or extractor which is capable of cleaning under overlying obstacles such as the projecting margin of built-in bathroom and kitchen cabinets or furniture such as beds, dressers and the like.

SUMMARY OF THE INVENTION

In accordance with the purposes of the present invention as described herein, an improved agitator is provided for use in upright vacuum cleaners, extractors and power nozzles of canister vacuum cleaners or the like. The agitator includes a high strength, continuous metal axle, a pulley held on one end of the metal axle and a sleeve of lightweight plastic material received over the axle. The sleeve carries a cleaning structure which may, for example, be selected from a group consisting of a beater bar, a brush, tufted bristles, a wiper and combinations thereof.

The sleeve may be cylindrical in shape and have a diameter no greater than about 22.00 mm. The axle may have a diameter of between about 4.00 mm to about 8.00 mm. In this way the axle acts as a high strength backbone for the sleeve while the sleeve has the necessary thickness to receive and securely hold the cleaning structures. Advantageously, the total construction has a low profile thereby allowing installation in even the most low profile nozzle assemblies, power heads or extractors.

The pulley includes a hub for securing to the axle. The pulley also includes a metal D-nut for engaging a stub shaft of a drive gear typically carried on the nozzle assembly, power head or housing of the vacuum cleaner or extractor to which the agitator is mounted. Still further the pulley includes a pair of projecting box ribs and the sleeve includes a pair of projecting flanges for receiving and engaging the box ribs. The sleeve also includes a collar and a pair of projecting lugs for engaging in the pair of box ribs. Together, the hub, projecting box ribs, collar, flanges and lugs provide an interlocking structure for securely fixing the pulley on the axle.

In accordance with yet another aspect of the present invention, a method of manufacturing an agitator is provided. The method includes the molding of a pulley onto a D-nut. This is followed by the step of fitting an axle into the pulley. Next is the step of molding a sleeve around the axle. Then comes the step of securing a cleaning structure on the sleeve.

In the following description there is shown and described one embodiment of the invention, simply by way of illustration of one of the modes best suited to carry out the invention. As it will be realized, the invention is capable of other different embodiments, and its several details are capable of modification in various, obvious aspects all without departing from the invention. Accordingly, the drawing and descriptions will be regarded as illustrative in nature and not as restrictive.

BRIEF DESCRIPTION OF THE DRAWING

The accompanying drawing incorporated in and forming a part of the specification, illustrates several aspects of the present invention, and together with the description serves to explain the principles of the invention. In the drawing.

Reference will now be made in detail to the embodiment of the invention illustrated in the accompanying drawings.

DETAILED DESCRIPTION OF THE INVENTION

Figures 1, 3A, 3B:
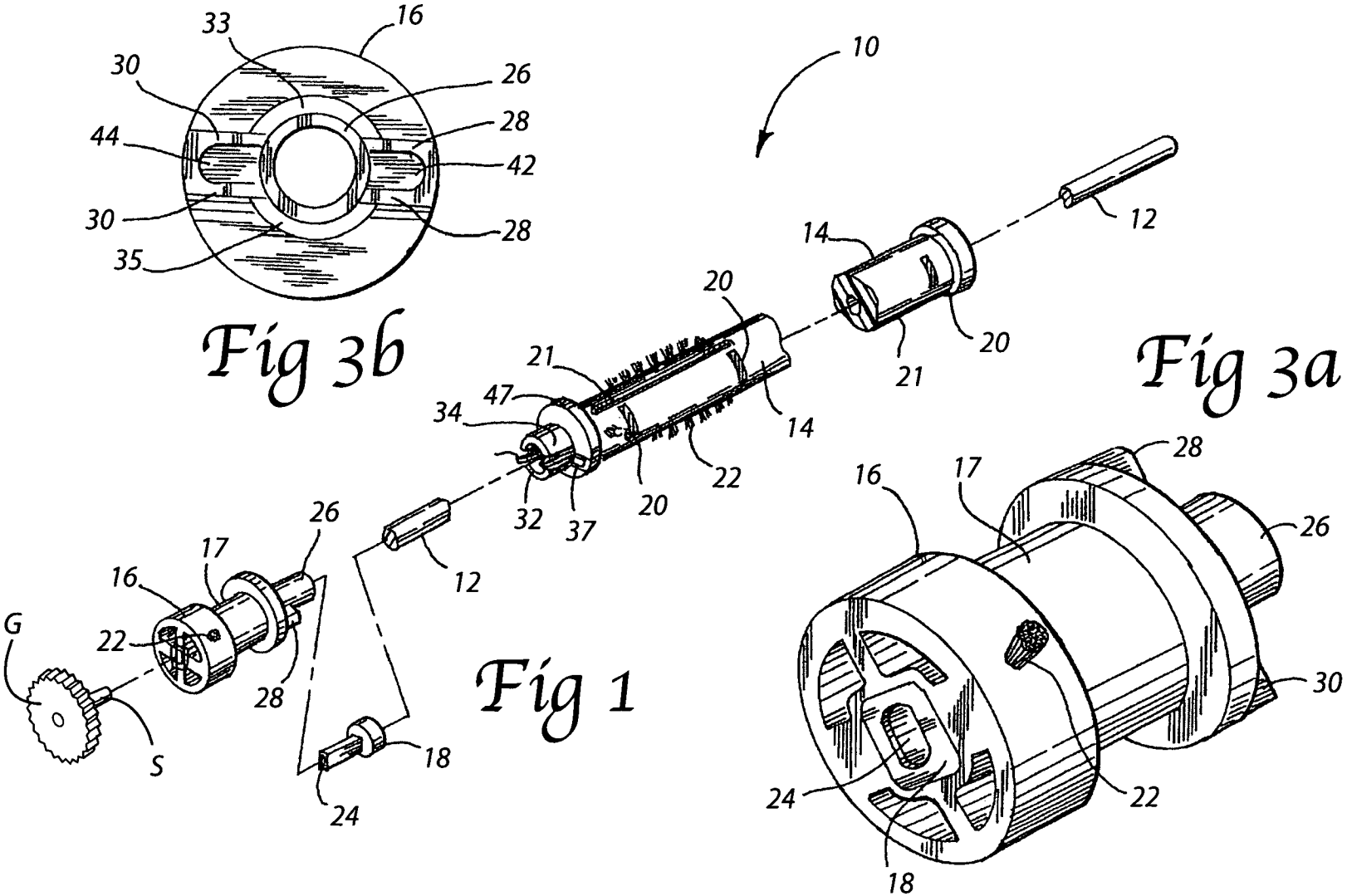
FIG. 1 is an exploded perspective view of the agitator of the present invention.
FIG. 3*a* is a perspective view of the end of the pulley secured to the axle of the agitator.
FIG. 3*b* is an end elevational view of the pulley shown in FIG. 3*a;*
Figure 2A:
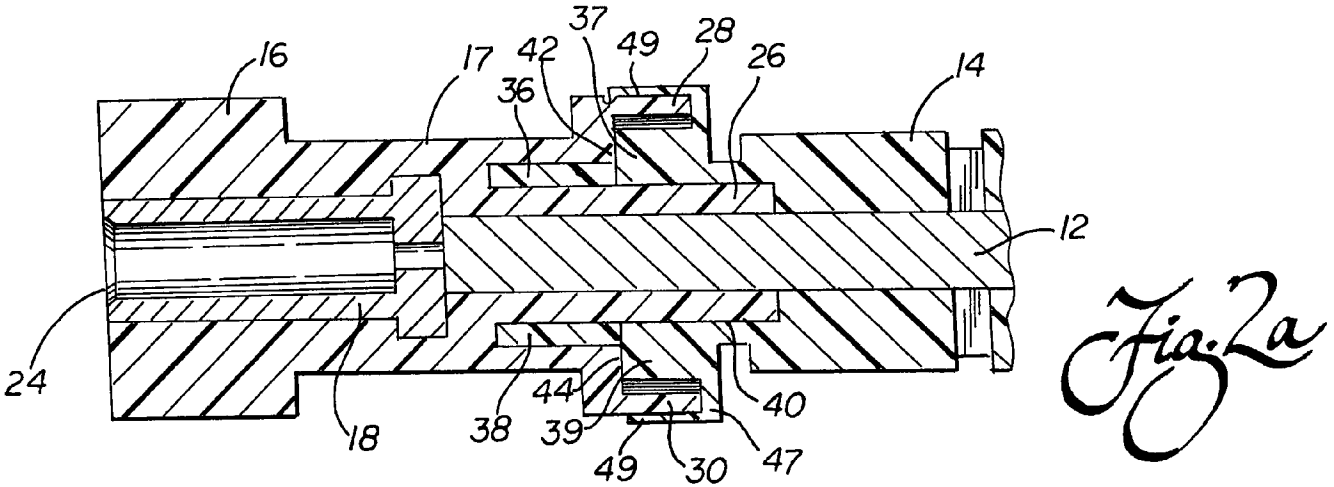
FIG. 2*a* is a detailed cross-sectional view of the agitator shown in FIG. 1.
Figure 2B:
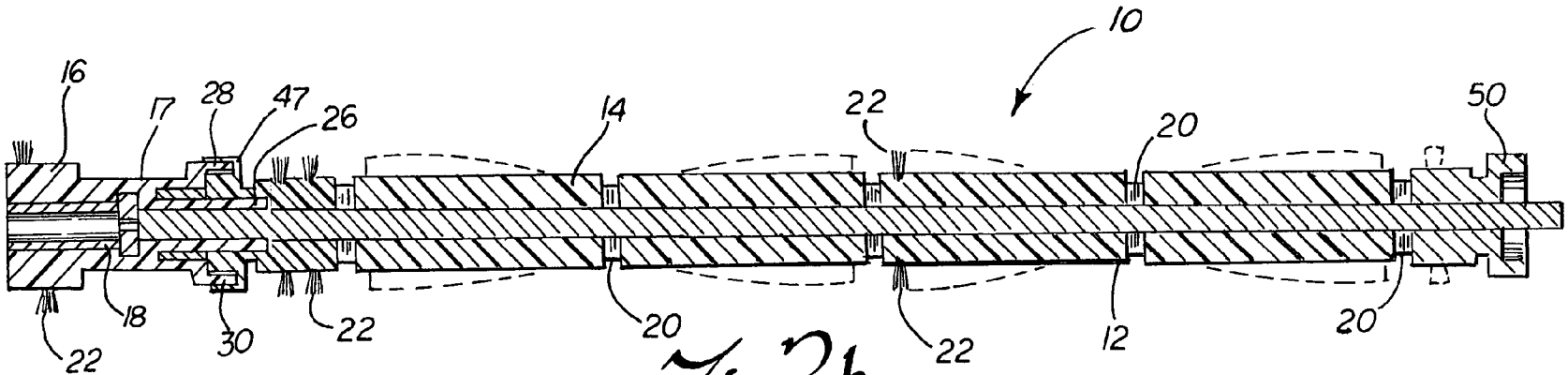
FIG. 2*b* is a full cross-sectional view of that agitator.

Reference is now made to the drawing figures and particularly FIGS. 1 and 2 showing the agitator 10 of the present invention. The agitator 10 generally comprises four component parts, the axle 12, the sleeve 14 on the axle and the pulley 16 including the metal support, mounting fixture or D-nut 18.

The axle 12 is a single continuous shaft of high strength metal and may have a diameter between about 4.00 to about 8.00 mm. The sleeve 14 around the axle 12 is preferably formed from molded plastic such as polypropylene/ABS or any other appropriate material. The sleeve 14 may include spaced through slots 20 and spaced, axially extending grooves 21. The slots 20 allow the axle 12 to be held during the sleeve molding process. The slots 20 and grooves 21 are also of sufficient size and depth to receive a scissor blade so that one may easily cut hair, string or other elongated material that might become entangled on and wrapped around the agitator 10. Thus, these slots 20 and grooves 21 greatly simplify the cleaning process.

The sleeve 14 is cylindrical in overall shape and has a diameter no greater than about 22 mm. As a result, the agitator 10 may be utilized in very low profile vacuum cleaners that provide the necessary clearance for cleaning under low overhangs such as furniture and kitchen and bathroom cabinet margins. The high strength metal axle 12 provides rigidity, strength and balance or TIR to the agitator 10 yet the relatively small diameter of the axle advantageously allows the agitator to be made with a small diameter or low overall profile as described.

As illustrated, the sleeve 14 includes two helical patterns of tufted bristles 22 which function as cleaning structures for brushing and beating the nap of a carpet as the agitator 10 is rotated at rpms up to 2,500–6,500 by the cleaning equipment (e.g. vacuum cleaner, power head, extractor) to which it is operatively mounted. More particularly, a series of holes are drilled in the sleeve 14 and the tufted bristles 22 are secured in those holes with an appropriate adhesive or by mechanical fastening means such as staples.

The pulley 16 may be formed from nylon or other appropriate material and is molded on the D-nut 18. The D-nut 18 is preferably formed from a high strength material such as sintered powder metal. The D-nut 18 includes an oblong socket 24 that is sized and shaped to receive a stub shaft S of an appropriate drive gear G which is held for relative rotation on the cleaning equipment to which the agitator is mounted.

Figure 4:
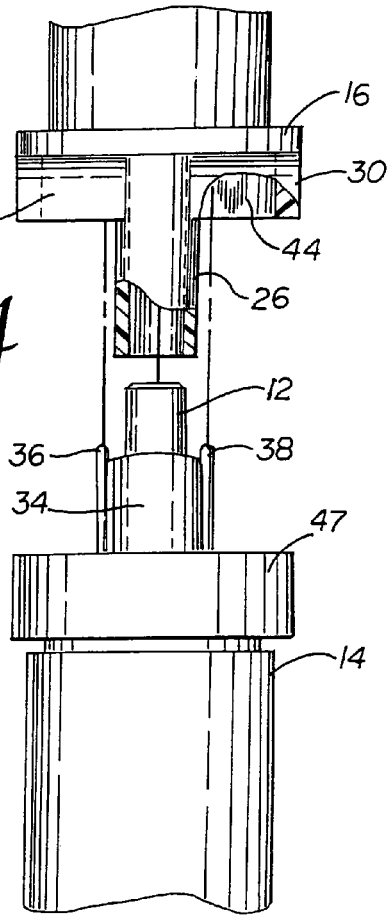
FIG. 4 is a detailed elevational view showing the connection of the pulley on the axle and sleeve.
Figure 3C:
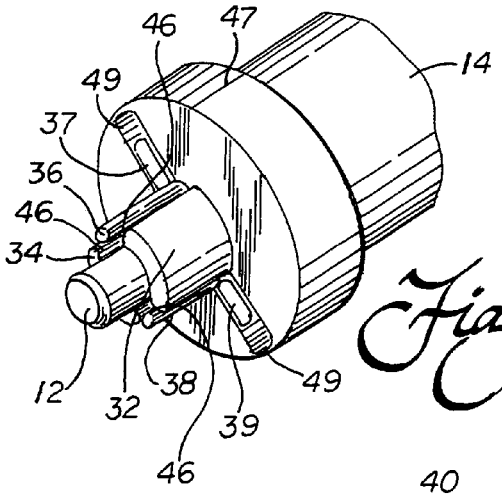
FIG. 3*c* is a perspective view of the axle and sleeve.
Figure 3D:
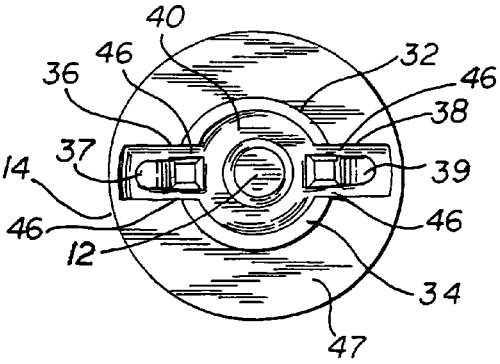
FIG. 3*d* is an end elevational view of the end of the axle and sleeve shown in FIG. 3*b*.

As best shown with reference to FIGS. 3*a*, 3*b* and 4, the molded portion of the pulley 16 includes a hub 26 and a pair of projecting box ribs 28, 30: the two box ribs extending in opposing radial directions from the hub. As best shown in FIGS. 3*c*, 3*d* and 4, the sleeve 14 includes a pair of projecting, arcuate flanges 32, 34 and a pair of projecting lugs 36, 38 with the flanges and lugs alternating around the axle 12. An annular gap 40 is provided between axle 12 and each of the flanges 32, 34 as well as each of the lugs 36, 38. The pulley 16, including the belt receiving channel 17, is secured to the axle 12 by pressing the two parts together so that (1) the hub 26 is received down in the gap 40, (2) the lug 36 is received in the slot 42 between the box ribs 28, (3) the lug 38 is received in the slot 44 between the box ribs 30 and (4) the flanges 32, 34 are received in respective slots 33, 35 in the pulley between the box ribs. Simultaneously, it should be appreciated that the walls of the box ribs 28, 30 are received in the channels 46 provided between each of the flanges 32, 34 and the lugs 36, 38.

The pulley 16 is press fit onto the end of the axle 12 and sleeve 14 until the walls of the box ribs 28, 30 are fully received in the cooperating slots 49 in the reinforced collar 47. In this position, the block-like bases 37, 39 of the respective lugs 36, 38 are fully received in and fill the slots 42, 44. It is the engagement of (1) the bases 37, 39 in the slots 42, 44 and (2) the walls of the box ribs 28, 30 in the channels 46 and the slots 49 in the collar 47 that keys the pulley 16 to the axle 12 and sleeve 14 so that they are fixed and rotate together.

The radially projecting collar 47 and similar radial projections 50 at the ends of the sleeve 14 function as barriers to prevent string, hair and other dirt and debris from contaminating and/or becoming entwined in the drive belt and agitator bearings.

The agitator 10 of the present invention is relatively easy to manufacture. The first step in the manufacturing process is the molding of the nylon portion of the pulley 16 onto the metal D-nut 18. This is followed by the fitting of the axle 12 into the hub 26 of the pulley 16. Next is the injection molding of the sleeve 14 around the axle 12. Following injection molding is the securing of a cleaning structure such as the tufted bristles 22 onto the sleeve 14. As noted above, this may be accomplished by drilling an appropriate pattern of apertures in the sleeve 14 and then utilizing a friction fit and an adhesive or staples to secure the bristles 22 in those apertures. Alternatively, dovetail channels, grooves or other structures may be provided for receiving and holding a wiper, a brush, a beater bar or other appropriate structures. Of course, such structures may also be molded integrally with the sleeve 14 when the sleeve is molded onto the axle 12 if desired.

In summary, numerous benefits result from employing the concepts of the present invention. The agitator 10 is made from inexpensive materials by means of a relatively simple and inexpensive manufacturing process. Further, the agitator 10 includes a high strength metal axle which forms a rigid spine over which relatively inexpensive plastic materials may be molded to provide a sleeve for receiving and holding the selected cleaning structure. Further, the overall agitator 10 may be produced with a relatively low profile for receipt and use in low profile cleaning equipment better capable of reaching under obstructions. Advantageously, the low profile of the agitator is achieved without compromising strength so that the agitator will function dependably and reliably over a long service life.

The foregoing description of the preferred embodiment of the invention has been presented for purposes of illustration and description. It is not intended to be exhaustive or to limit the invention to the precise form disclosed. Obvious modifications or variations are possible in light of the above teachings. The embodiment was chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally and equitably entitled. The drawings and preferred embodiment do not and are not intended to limit the ordinary meaning of the claims and their fair and broad interpretation in any way.

What is claimed is:

1. An agitator, comprising:

a continuous metal axle;

a pulley held on one end of said metal axle, said pulley including a metal D-nut;

a sleeve of lightweight plastic material received over said metal axle wherein said sleeve is cylindrical in shape having a diameter no greater than 22.00 mm.

2. The agitator of claim 1, wherein said sleeve carries a cleaning structure.

3. The agitator of claim 2, wherein said cleaning structure is selected from a group consisting of a beater bar, a brush, tufted bristles, a wiper and combinations thereof.

4. The agitator of claim 1, wherein said axle has a diameter between about 4.00 mm to about 8.00 mm.

5. The agitator of claim 1, wherein said pulley includes a hub for securing to said axle.

6. The agitator of claim 1, wherein said pulley includes a pair of projecting box ribs and said sleeve includes a pair of projecting flanges for receiving said box ribs.

7. The agitator of claim 6, wherein said sleeve also includes a collar and a pair of projecting lugs for engaging in a cooperating pair of slots in said pair of box ribs.

8. The agitator of claim 7, wherein said collar includes a pair of slots for receiving said box ribs.

9. The agitator of claim 8, wherein said pulley includes a projecting hub and said collar includes a gap for receiving and holding said hub.

10. An agitator and drive gear assembly for a vacuum cleaner, comprising:

an axle;

a pulley held on said axle;

a sleeve received over said axle;

a drive gear having a stub shaft; and said pulley including a mounting fixture for engaging said stub shaft of said drive gear.

11. The agitator and drive gear assembly of claim 10, wherein said pulley includes a pair of projecting box ribs and said sleeve includes a pair of projecting flanges for receiving and engaging said box ribs.

12. The agitator and drive gear assembly of claim 11, wherein said sleeve also includes a collar and a pair of projecting lugs for engaging in said pair of box ribs.

* * * * *